United States Patent [19]

Pilch

[11] 4,235,567

[45] Nov. 25, 1980

[54] MATERIAL HANDLING MACHINE WITH ADJUSTABLE SPEED-POWER RELATIONSHIP FOR BOOM MOVEMENT

[75] Inventor: John S. Pilch, Ware, Mass.

[73] Assignee: Ware Machine Service, Inc., Ware, Mass.

[21] Appl. No.: 28,970

[22] Filed: Apr. 11, 1979

[51] Int. Cl.[3] ..... E02F 3/00

[52] U.S. Cl. ..... 414/694; 74/522; 92/13

[58] Field of Search ..... 414/685, 686, 694, 695, 414/727; 92/13, 118; 74/522, 571 M; 280/764

[56] References Cited

U.S. PATENT DOCUMENTS

| | | | |
|---|---|---|---|
| 2,662,420 | 12/1953 | French et al. | 74/522 X |
| 3,148,749 | 9/1964 | Goorjon | 414/694 |
| 3,373,661 | 3/1968 | Reichard | 74/522 X |
| 3,388,819 | 6/1968 | Przybylski | 414/694 |
| 3,392,855 | 7/1968 | Przybylski | 414/694 |
| 3,441,154 | 4/1969 | Przybylski | 414/694 |
| 3,734,320 | 5/1973 | Redenbarger | 414/694 |
| 4,013,307 | 3/1977 | Dowd et al. | 280/764 |

FOREIGN PATENT DOCUMENTS

| | | | |
|---|---|---|---|
| 1288021 | 1/1969 | Fed. Rep. of Germany | 414/694 |

*Primary Examiner*—Stephen G. Kunin
*Assistant Examiner*—Terrance L. Siemens
*Attorney, Agent, or Firm*—Thompson, Birch, Gauthier & Samuels

[57] ABSTRACT

In a material handling machine having a turret, a boom supported by the turret for movement about a first pivot, and a piston-cylinder unit for pivoting the boom about the first pivot, the piston-cylinder unit being supported by the turret for pivotal movement about a second pivot parallel to the first pivot, the improvement comprising at least one of the aforesaid pivots being journalled for rotation in the bore of an eccentric sleeve member which is in turn journalled for adjustable rotation in the turret. Rotation of the eccentric sleeve produces a change in the distance between the first and second pivots, with an accompanying variation in the speed-power relationship of boom movement.

9 Claims, 6 Drawing Figures

MATERIAL HANDLING MACHINE WITH ADJUSTABLE SPEED-POWER RELATIONSHIP FOR BOOM MOVEMENT

TECHNICAL FIELD

This invention relates generally to material handling machines of the type having pivotal power-operated booms and is concerned in particular with an improved means for varying the speed-power relationship of boom movement.

BACKGROUND OF PRIOR ART

Various arrangements have been proposed for varying the speed-power relationship of boom movement in material handling machines of the type referred to above. Examples of known prior art arrangements are disclosed in Przybylski U.S. Pat. Nos. 3,388,819; 3,441,154 and 3,392,855. In these prior art patents, either the boom pivot or the boom cylinder pivot is pivotally carried on a control link which is in turn pivotally mounted on a boom support. Pivotal adjustment of the control link, and hence the speed-power relationship of boom movement, is achieved through the use of an additional piston-cylinder unit operatively connected between the boom support and the control link.

This type of arrangement is characterized by a number of disadvantages. For example, by interposing a control link between the boom support and either the boom pivot or boom cylinder pivot, the number of pins, pin bores and associates components is increased substantially, with a concomitant increase in the overall cost of the machine. This problem is further aggravated by the need to employ an additional piston-cylinder unit (with accompanying valve, hoses, etc.) to adjust the position of the control link and to hold it in place during operation of the machine. Such arrangements also are more susceptible to wear because of the increased "play" resulting from the multiple pivot points associated with each control link. An undesirable decrease in strength and rigidity also results from supporting either the boom pivot or boom cylinder pivot on a pivotal control link, which as compared to the heavier and more rugged boom support, is much less able to withstand bending and torsional stresses. The prior art pivotal control link arrangements also suffer from a lack of compactness, particularly where the boom pivots are link-mounted for adjustable movement beyond the confines of the boom support, as shown for example in U.S. Pat. No. 3,388,819.

BRIEF SUMMARY OF INVENTION

The present invention avoids the above-mentioned problems by employing an eccentric sleeve member to adjustably carry the boom pivot and/or the boom cylinder pivot. The eccentric sleeve member is rotatably journalled in the rugged side plates of the turret. Thus, operational stresses are transmitted through the eccentric sleeve directly to the turret side plates. Instead of requiring auxiliary power means to effect adjustments, the eccentric sleeve member of the present invention can be manually rotated and then locked in place with a simple clamp arrangement. This, together with the fact that less pivot points are required with an eccentric sleeve arrangement, results in significant economies. The path of pivot adjustment, whether it be the boom pivot or the boom cylinder pivot, is always located within the circumference of the eccentric sleeve and hence within the confines of the turret. The resulting compactness of this arrangement is advantageous in that it allows the pivot axes to be located nearer to the vehicle center of gravity.

DETAILED DESCRIPTION OF INVENTION

Figure 1:
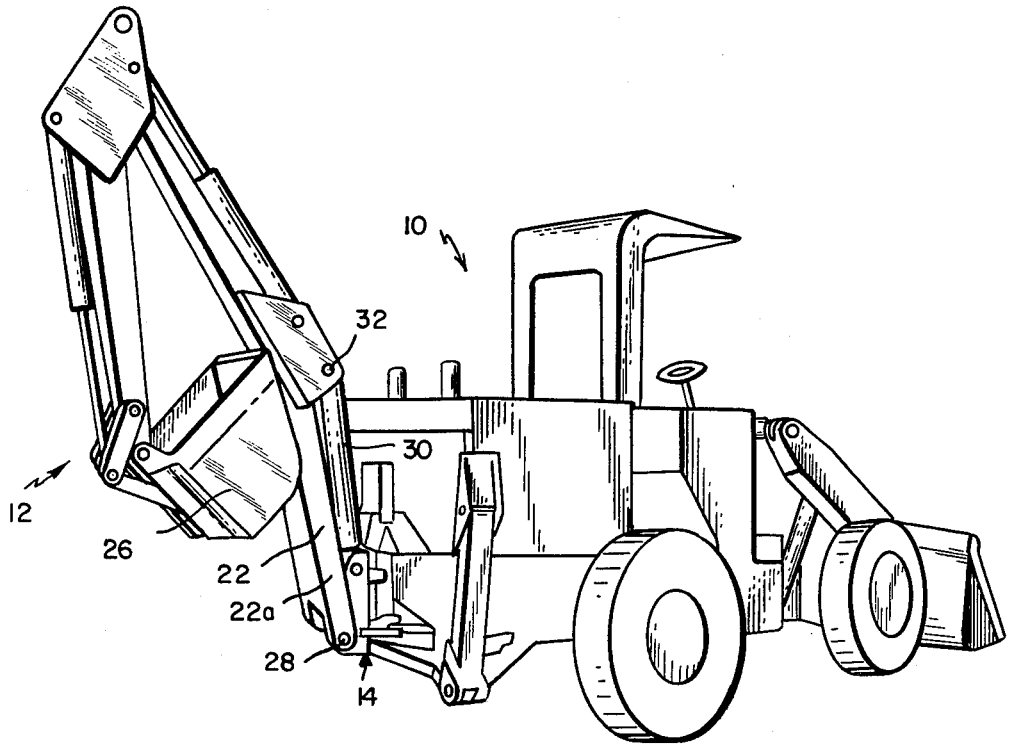
FIG. 1 is a perspective view of a material handling machine having one embodiment of the present invention associated therewith.

Referring now to the drawings, there is shown in FIG. 1 a material handling machine 10 of generally conventional design carrying a detachable backhoe assembly 12. As can best be seen by further reference to FIGS. 2 and 3, the backhoe assembly 12 includes a turret 14 comprising parallel side walls 16*a*, 16*b* interconnected by transverse horizontal webs 18. The turret is supported in a known manner for pivotal movement about a vertical axis 20.

The backhoe assembly 12 further includes a boom 22 carrying a pivotal dipper stick with a bucket 26 pivotally supported at its distal end. The boom 22 is provided at its lower end with boom ears 22*a*, 22*b* which straddle the turret 14. The boom ears are mounted for pivotal movement about a first boom pivot 28 defined by a heavy duty pin.

Pivotal movement is imparted to the boom 22 by a power means comprising a piston-cylinder unit 30. Unit 30 is pivotally connected at one end to the boom 22 at 32. The other end of piston-cylinder unit 30 is mounted for pivotal movement about a second boom cylinder pivot 34, also defined by a heavy duty pin. The pivots 28, 34 are parallel.

Figure 2:
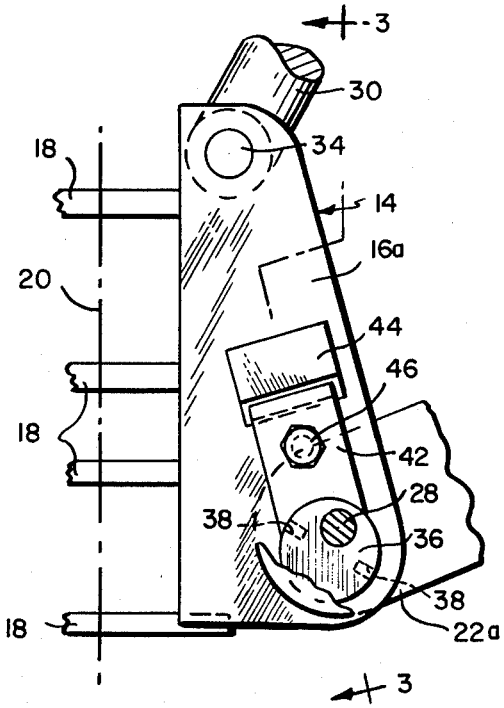
FIG. 2 is an enlarged view in side elevation, with portions broken away, showing the turret pivotally supporting the boom and boom cylinder pivot.
Figure 3:
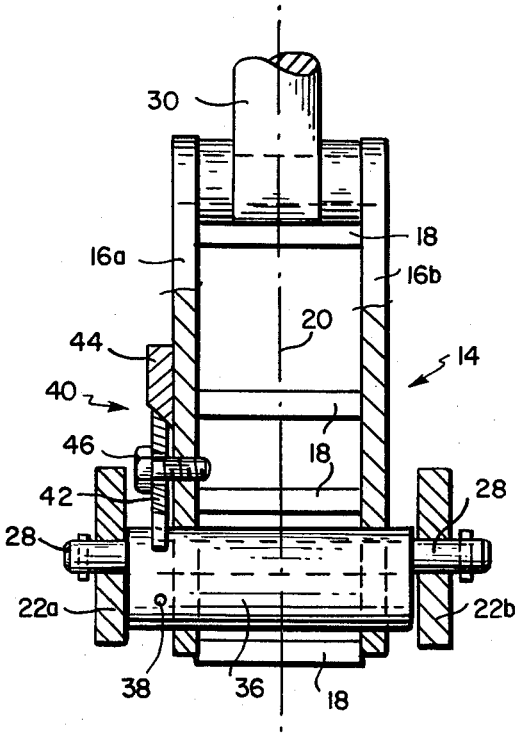
FIG. 3 is a sectional view taken along lines 3—3 of FIG. 2.

In the embodiment shown in FIGS. 1–3, the boom cylinder pivot 34 extends through and is journalled by the turret side plates 16*a*, 16*b*. In contrast, the boom pivot 28 is journalled in the bore of an eccentric sleeve member 36. The eccentric sleeve member extends through and is itself journalled for adjustable rotation in the turret side walls 16*a*, 16*b*. As is best shown in FIG. 3, the opposite ends of the eccentric sleeve member 36 protrude beyond the turret side walls. These protruding ends are confined between the boom ears 22*a*, 22*b*. One of the protruding ends is provided with apertures 38 for receiving detachable pins or handles (not shown) which can be used by operating personnel to rotatably adjust the eccentric sleeve member. Rotation of eccentric sleeve member 36 to move the boom pivot 28 from the position shown in FIG. 2 to another position such as for example that shown in dotted at 28' in FIG. 4 will result in the distance D between pivots 28, 34 being increased by $\Delta D$. The resulting effects of this type of adjustment on the speed-power relationship of boom movement are well known to those skilled in the art.

The eccentric sleeve member 36 is rotatably fixed in any given position of adjustment by a clamp means generally indicated at 40. The clamp means includes a clamp plate 42 having one end suitably shaped and adapted to frictionally engage the cylindrical outer surface of one protruding end of the eccentric sleeve member. The opposite end of the clamp plate has an inclined surface in slidable engagement wih an oppositely inclined surface on a plate 44 fixed relative to the turret side plate 16*a*. A bolt extends through an elongated opening 48 in the clamp plate 42 and is threaded into the turret side wall 16*a*.

When the bolt 46 is tightened, the oppositely inclined surfaces on plates 42, 44 coact to force the plate 42 into frictional engagement with the eccentric sleeve member 36, thereby rotatably fixing the eccentric sleeve member in any desired position of adjustment.

Figure 4:
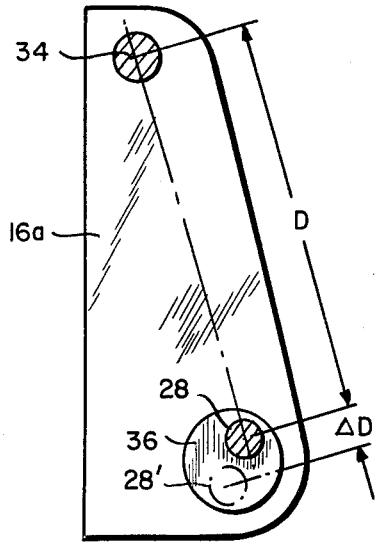
FIG. 4 is a schematic illustration showing the change in distance between the boom pivot and boom cylinder pivot resulting from a rotatable adjustment of the eccentric sleeve member; and, FIGS. 5 and 6 are views similar to FIG. 2 showing alternate embodiments of the invention.
Figure 5:
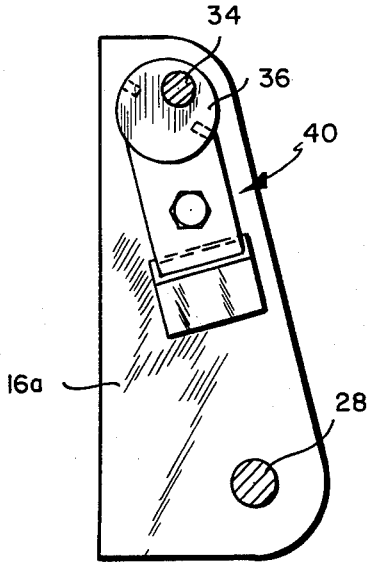
Figure 6:
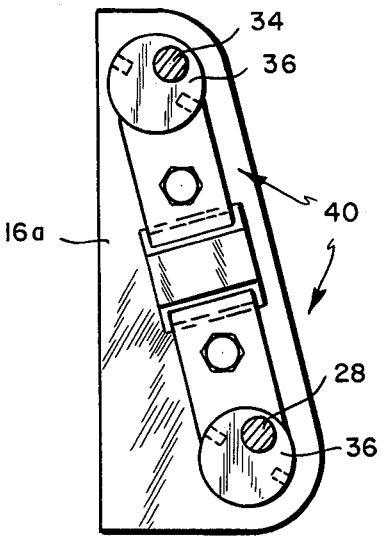

FIG. 5 shows an alternate embodiment of the invention where the boom pivot 28 rotates about a fixed axis and the boom cylinder pivot 34 is journalled in the bore of a rotatably adjustable eccentric sleeve member 36. In FIG. 6, still another embodiment of the invention is shown where both the boom pivot 28 and the boom cylinder pivot 34 are journalled in the bores of eccentric sleeve members 36. As with the preferred embodiment of FIGS. 1–4, the eccentric sleeve members 36 of the alternate embodiments shown in FIGS. 5 and 6 are also rotatably fixed at desired positions of adjustment by clamp means 40.

Having thus described several embodiments of the present invention, the advantages to be derived therefrom will now be appreciated by those skilled in the art. Among these advantages is the ability to adjust the distance D between the first and second pivots 28, 34 by utilizing the structural rigidity provided by the rugged side plates 16*a*, 16*b* of the turret 14. The present invention involves less components and pivot points than the known link-type adjustment mechanisms of the prior art. This enables a realization of cost savings, which are further enhanced by the fact that the present invention can be manually adjusted and locked in position without the need for additional power means.

As can best be seen by reference to FIGS. 4–6, the paths of adjustment of the pivotal axes 28 and/or 34 are always located within the circumferences of the eccentric sleeves 36 and hence within the confines of the turret side walls 16*a*, 16*b*. In addition to minimizing looseness and "play", this provides a compactness of design which has heretofore been unobtainable with prior art link-type arrangements.

I claim:

1. In a material handling machine having a turret, a boom supported by said turret for movement about a first pivot, and power means for pivoting said boom about said first pivot, said power means being connected to said boom and being supported by said turret for pivotal movement about a second pivot parallel to said first pivot, the improvement comprising: at least one of said pivots being journalled for rotation in the bore of an eccentric sleeve member, said sleeve member in turn being journalled for adjustment rotation in said turret, whereupon rotation of said sleeve member produces a change in the distance between said pivots, with an accompanying variation in the speed-power relationship of boom movement.

2. The material handling machine of claim 1 wherein both said first and second pivots are journalled for rotation in the bores of eccentric sleeve members journalled for adjustable rotation in said turret.

3. The material handling machine of claim 1 further comprising clamp means carried by said turret for rotatably fixing said eccentric sleeve member in a desired position of adjustment.

4. The material handling machine of claim 3 wherein said clamp means includes a clamp plate having one end adapted to frictionally engage the cylindrical external surface of said eccentric sleeve member, the opposite end of said clamp plate having an inclined surface in slidable engagement with an oppositely inclined surface fixed relative to said turret, and means for moving said plate towards or away from said turret, with the slidable engagement of said inclined surfaces producing an accompanying movement of said plate into or out of frictional engagement with said eccentric sleeve member.

5. The material handling machine of claim 1 wherein said turret includes spaced side walls, said eccentric sleeve member extending between and being journalled in said side walls.

6. The material handling machine of claim 5 wherein the ends of said eccentric sleeve protrude beyond the exterior surfaces of said side walls.

7. The material handling machine of claim 6 wherein one of the protruding ends of said eccentric sleeve member is provided with openings adapted to receive tool means for rotatably adjusting said eccentric sleeve member.

8. The material handling machine of claim 1 wherein the path of adjustment of said one pivot is located within both the circumference of said eccentric sleeve and the confines of said turret.

9. The material handling machine of claim 1 wherein said turret is provided with spaced side walls, said eccentric sleeve member extends between and is journalled for rotation in said side walls, and the ends of the said one pivot protrude beyond the ends of said eccentric sleeve member to receive spaced ear members on said boom.

* * * * *